United States Patent [19]

Lafon

[11] 4,211,248

[45] Jul. 8, 1980

[54] DISPENSING MACHINE, IN PARTICULAR FOR COINS

[76] Inventor: Guy Lafon, 41 Chemin des Semailles, Grand-Lancy, Geneva, Switzerland

[21] Appl. No.: 573,137

[22] Filed: Jun. 24, 1975

[51] Int. Cl.[2] ..... G07D 9/06

[52] U.S. Cl. ..... 133/1 R; 221/186

[58] Field of Search ..... 133/1 R, 1 A, 3 R, 3 A, 133/3 H, 8 R, 8 A; 221/186, 182, 167

[56] References Cited

U.S. PATENT DOCUMENTS

| | | | |
|---|---|---|---|
| 3,063,596 | 11/1962 | D'Autheville et al. | 221/182 X |
| 3,376,970 | 4/1968 | Roseberg | 194/1 X |
| 3,702,663 | 11/1972 | Joele | 221/167 |
| 3,960,293 | 6/1976 | Sweet et al. | 221/167 X |

*Primary Examiner*—Francis J. Bartuska

*Attorney, Agent, or Firm*—Browdy and Neimark

[57] ABSTRACT

A dispensing machine, includes a vat 1. The vat the axis of which is vertical, encloses a slanting disk 2 which is internally tangential thereto along two distinct surfaces: a lower frustum of cone 5, and an upper cylindrical surface 6. The axis of the plate is offset with respect to the axis of the cylinder, in the direction of the highest point 11 of said plate. The coins are dropped in bulk on the lowermost part of the rotating plate, which causes them to rise again and leads them onto a rotating annular rim 7, the latter ejecting the coins according to a common direction.

9 Claims, 3 Drawing Figures

DISPENSING MACHINE, IN PARTICULAR FOR COINS

BACKGROUND OF THE INVENTION

The present invention relates to a dispensing machine, adapted to be used, in particular, for coins.

This machine is intended for receiving coins which are substantially identical with each other. Said coins are supplied in bulk to the machine, which forwards them according to a fixed direction and a common orientation. Said machine, when associated to a photoelectric cell disposed in the path of distribution of the coins and connected to an impulse counter, is used for counting coins.

SUMMARY OF THE INVENTION

A dispensing machine according to the invention includes a coin receiving vat rotating about its vertically directed axis of revolution, inside which a circular plate revolves, the axis of which lies at an acute angle to the vertical, and is characterized in that the inner walls of the vat appear from bottom to top as including two portions, to wit:

a portion in the shape of a frustum of a cone, which flares upwards, a cylindrical portion having the same diameter as the greater base of said frustum of a cone, while the center of the upper surface of the plate lies in the plane of said greater base, at a small distance from the axis of revolution of the vat in the direction of the highest point of the plate, so that the clearance between the outer diameter of the plate and the inner walls of the vat is substantially uniform.

According to a further feature of the invention, the lateral surface of the plate is a frustum of a cone which flares upwards, so that the minimum clearance between the plate and the vat is that clearance which is allowed at the level of the greater base of the frustum of a cone.

According to a further feature of the invention, the plate is substantially tangential, close to its highest point, to a rotary flat annular rim, so that the coins can be brought onto said rim by the plate. The outer diameter of the flat annular rim is limited by a cylindrical surface having the same axis as the vat, so that the coins rotarily driven by the rim are held against said cylindrical surface by the centrifugal force.

According to a modified embodiment of the invention, the outer diameter of the flat annular rim is limited by a substantially cylindrical surface constituted by at least one sector having a vertical axis and provided with means allowing the distance between said surface and the axis of the rim to vary, so as to modify the useful width of said rim at will.

A lateral opening is provided in the surface which borders the annular rim, so that the coins are ejected through said opening along a common direction. The width of the annular rim is substantially equal to the diameter of the coins to be dispensed, so that only one coin can be held on a surface defined in part by the width of said rim.

According to a further feature of the invention, the vat is rigid with the flat annular rim, the latter constituting the upper edge of said vat.

According to a further feature of the invention, the vat is imparted a rotatory motion faster than that of the plate.

The accompanying drawing, which is given only by way of nonlimiting example, will allow to understand the features of the invention more clearly.

DESCRIPTION OF THE PREFERRED EMBODIMENT

Figure 1:
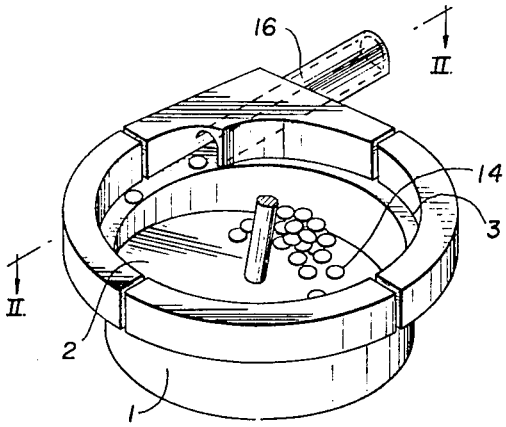
FIG. 1 is a perspective view of a machine according to the invention.

FIG. 1 shows the vat 1, inside which the plate 2 is disposed. At the upper part of the vat an ejection chute 16 passes through one of the sectors of the cylindrical surface 3.

Figure 3:
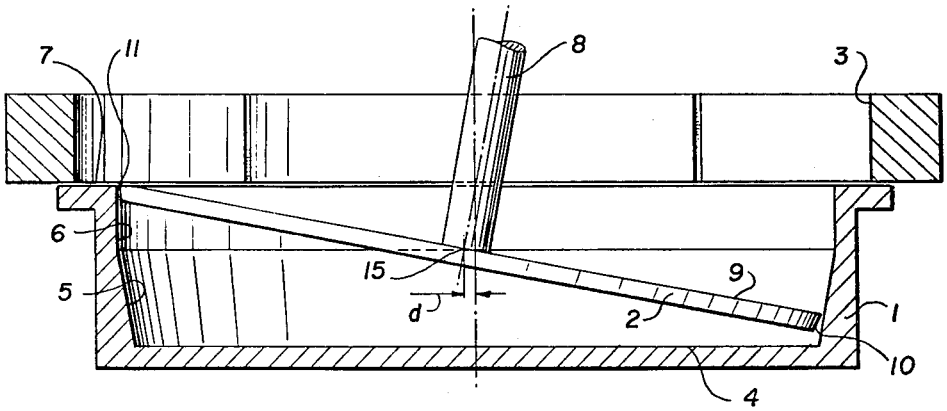
FIG. 3 is a sectional view along line III—III of FIG. 2.

The vat 1 has an axis of revolution which is vertically directed (FIG. 3). The vat 1 is provided with driving means (not shown) which rotate it.

The inside of the vat is constituted by:

a flat bottom 4, a portion 5 in the shape of a frustum of a cone, which flares upwards, a cylindrical portion 6, which has the same diameter as the greater base of the frustum of a cone, and constitutes an upwardly directed extension of the greater base. The upper edge of the vat is a flat annular surface 7.

The plate 2 is circular in shape, and includes a shaft 8, the axis of which coincides with the axis of revolution of the plate. The axis is at an acute angle to the vertical, while the center 15 of the surface 9 of the plate 2 lies in the plane of the greater base of the frustum of a cone 5. Moreover, the center is slightly spaced from the axis of revolution of the vat, towards the highest point 11 of the plate 2, by a distance d (FIG. 3). The lateral surface 10 of the plate 2 is a frustum of a cone, the greater base of which is the surface 9. The respective proportions of the plate 2 and the vat 1 are such that the clearance between the edge of the surface 9 and the inner walls of the vat is small and uniform. The highest point 11 of the plate lies in the same plane as the upper edge 7 of the vat. The shaft 8 is rigid with driving means (not shown) which rotate it.

The free surface of the upper edge 7 of the vat is bounded by the diameter of the surface 3. The circumference is constituted by eight sectors 12 each of which define one respective portion of a cylinder having the same axis as the vat. Each sector is movable along a radial direction in the same plane as shown diagrammatically by lines 17 indicating respective linkage to respective moving devices (not shown), whereby the diameter of the circumference is adjustable, the radial movements of the sectors being simultaneous through the agency of a device which is not shown. The sectors remain fast during the rotation of the plate and vat, and a clearance is provided between them and the annular surface 7.

One of the sectors, shown as numeral 13, includes an ejection chute 16, in prolongation of a line tangential to the mean radius of the annular surface 7.

Figure 2:
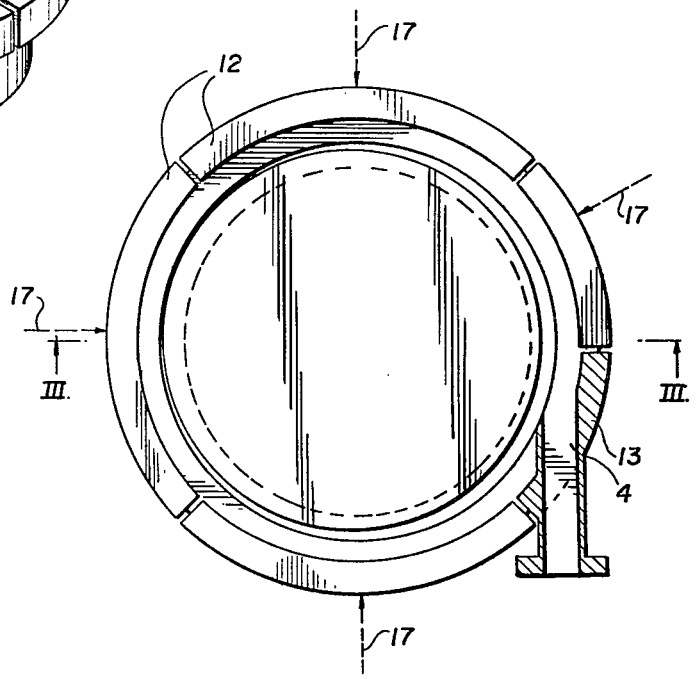
FIG. 2 is a top plan view of said machine, partly in section along line II—II of FIG. 1.

The direction of the chute 16 sets the direction of rotation of the plate 2 of the vat 1. As seen from above (FIG. 2), the direction being clockwise. The speed of rotation of the vat is greater than that of the plate.

The chute 16 is diametrally opposed to the highest point 11 of the plate 2.

The operation is as follows:

The coins are poured in bulk into the vat 1, on the lower part 14 of the plate 2 (FIG. 1). The rotation of the plate leads the coins towards the highest point 11, from which they are able to slide over the annular surface 7, the latter drawing them round in its rotation, while the centrifugal force holds them against the surface 3. After covering about half a turn, the coins are thrown one by one into the ejection chute 16 according to a direction, a speed and an orientation which are common to all of them.

The clearance which is uniformly distributed between the plate and the vat can be selected to be very small, which allows to use the machine for dispensing a great variety of articles, coins or the like, and even pointed articles such as nails or small screws. There is no risk for the points of these latter articles to enter the clearance if the size of said articles is large enough.

The radial adjustment of the sectors 12 is carried out in a manner such that only one coin can lay flat over the width of the flat annular rim 7.

I claim:

1. In a dispensing machine for coins and the like, comprising a coin receiving vat rotatable about its vertically directed axis of revolution, a revolvable, inclined, circular plate positioned inside said vat and revolvable about an axis which lies at an acute angle to said axis of revolution of said vat, and a rim extending along at least a portion of the periphery of said vat adapted to draw the coins with it in its rotatory motion to eject said coins through a side opening, according to a common direction, the improvement wherein the inner wall of said vat appear from bottom to top as including two portions, to wit:

a first portion in the shape of a frustum of cone, which flares upwards and a cylindrical portion having the same diameter as the greater base of said frustum of cone, while the center of the upper surface of said plate lies in the plane of said greater base, at a small distance from said axis of revolution of said vat towards the highest point of said inclined plate, said distance being a function of the dip of said plate, so that the clearance between the outer diameter of said plate and said inner wall of said vat is substantially uniform.

2. An improved dispensing machine according to claim 1, wherein the lateral surface of said plate is a frustum of cone which flares upwards, so that the minimum clearance between said plate and said vat is that clearance which is allowed at the level of said greater base of said frustum of cone.

3. An improved dispensing machine according to claim 1, wherein said plate is substantially tangential, close to its highest point, to a flat annular rotary rim, the useful width of which is externally limited by a cylindrical surface which has the same axis and does not rotate, so that coins can be brought onto said rim by said plate, and then drawn round with said rim by rotation thereof, these coins being held against said cylindrical surface by a centrifugal force.

4. An improved dispensing machine according to claim 3, wherein said cylindrical surface is constituted by at least one radially movable sector whereby the distance between said surface and the axis of the rim may be varied, so as to modify at will the useful width of said rim.

5. An improved dispensing machine according to claim 4, wherein said vat is rigid with said flat annular rim, the latter defining the upper edge of said vat.

6. An improved dispensing machine according to claim 5, wherein said rim is imparted a rotatory motion faster than that of said plate.

7. An improved dispensing machine according to claim 3, wherein said rim is imparted a rotatory motion faster than that of said plate.

8. An improved dispensing machine according to claim 4, wherein said rim is imparted a rotatory motion faster than that of said plate.

9. An improved dispensing machine according to claim 3, wherein said vat is rigid with said annular rim, the latter defining the upper edge of said vat.

* * * * *